US011565379B1

(12) United States Patent
Nelson

(10) Patent No.: US 11,565,379 B1
(45) Date of Patent: Jan. 31, 2023

(54) FILTER HOOK SYSTEMS

(71) Applicant: Fagan Nelson, Melbourne, FL (US)

(72) Inventor: Fagan Nelson, Melbourne, FL (US)

( * ) Notice: Subject to any disclaimer, the term of this patent is extended or adjusted under 35 U.S.C. 154(b) by 178 days.

(21) Appl. No.: 17/066,240

(22) Filed: Oct. 8, 2020

Related U.S. Application Data

(60) Provisional application No. 62/912,422, filed on Oct. 8, 2019.

(51) Int. Cl.
*B25B 9/00* (2006.01)
*F21V 33/00* (2006.01)

(52) U.S. Cl.
CPC ..... *B25B 9/00* (2013.01); *F21V 33/0084* (2013.01)

(58) Field of Classification Search
CPC ..... B25B 9/00; F21V 33/0084
See application file for complete search history.

(56) References Cited

U.S. PATENT DOCUMENTS

| | | | | |
|---|---|---|---|---|
| 5,487,576 | A | 1/1996 | DuVivier | |
| 7,490,880 | B1 | 2/2009 | Matsui | |
| 8,075,031 | B2 * | 12/2011 | Walker, Jr. ..... | B01D 46/4227 403/53 |
| 8,308,209 | B1 | 11/2012 | Bibow et al. | |
| 9,816,659 | B1 | 11/2017 | Osborne | |
| 2004/0100109 | A1 | 5/2004 | Johnson | |

* cited by examiner

*Primary Examiner* — Jason M Han
(74) *Attorney, Agent, or Firm* — Ashkan Najafi

(57) ABSTRACT

The filter hook includes a pipe, a rod slidably disposed through the pipe, a hook-shaped implement statically coupled to the rod and disposed exterior of the pipe, a bracket attached to an exterior of the pipe and spaced from the rod, a flashlight attached to the bracket and disposed opposite to the handle portion and adjacent to the second end cap, a magnet statically coupled to the second end cap and configured to support the pipe and the rod at a stationary position at the existing industrial air-handler of the existing ventilation system, and a fastener adjustably mated to the second end cap and oriented transversely to the rod. The fastener is configured to permit selected reciprocal displacement of the rod and the hook-shaped implement through the second end cap and relative to a position of the pipe.

20 Claims, 5 Drawing Sheets

FILTER HOOK SYSTEMS

CROSS REFERENCE TO RELATED APPLICATIONS

This is a non-provisional patent application that claims priority to and benefit of U.S. provisional patent application No. 62/912,422, filed Oct. 8, 2019, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to filters and, more particularly, to a filter hook configured to remove a filter from an existing industrial air-handler of an existing ventilation system, as well as facilitate a hands-free illuminated inspection of at least existing heating and cooling air coils of the existing ventilation system.

Prior Art

Many individuals and companies live and work in residential and commercial buildings. The buildings all require systems for air movement; heating and cooling; plumbing, electrical and the like. filters are often used to remove unwanted contaminants to make the fluids (including air) fresh and clean. Removal of filters may be difficult. As every Air-conditioning maintenance tech knows the removal of industrial air-handler filters may be a time-consuming process. A suitable solution is desired.

Various attempts have been made to solve problems found in filter art. Among these are found in: U.S. Pat. Nos. 8,308,209; 5,487,576; 7,490,880; 9,816,659; and 2004/0100109. This prior art is representative of filters and tools.

Accordingly, a need remains for filter hook in order to overcome at least one aforementioned shortcoming. The exemplary embodiment(s) satisfy such a need by providing a reliable filter hook that is convenient and easy to use, lightweight yet durable in design, versatile in its applications, and configured to remove a filter from an existing industrial air-handler of an existing ventilation system, as well as facilitate a hands-free illuminated inspection of at least existing heating and cooling air coils of the existing ventilation system.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a filter hook configured to remove a filter from an existing industrial air-handler of an existing ventilation system, as well as facilitate a hands-free illuminated inspection of at least existing heating and cooling air coils of the existing ventilation system. These and other objects, features, and advantages of the non-limiting exemplary embodiment(s) are provided by a filter hook including a pipe having a handle portion suitably configured to enable a user to manipulate the pipe and grab an existing filter from an existing industrial air-handler and existing heating and cooling air coils of an existing ventilation system. Such a pipe is hollow and has an elongated rectilinear tube shape provided with a proximal end and an axially opposed distal end. The pipe further includes a first end cap attached to a proximal end of the pipe, and a second end cap attached to a distal end of the pipe. The filter hook further includes a rod slidably disposed through the pipe, a hook-shaped implement statically coupled to the rod and disposed exterior of the pipe, a bracket attached to an exterior of the pipe and spaced from the rod, a flashlight attached to the bracket and disposed opposite to the handle portion and adjacent to the second end cap, a magnet statically coupled to the second end cap and configured to support the pipe and the rod at a stationary position at the existing industrial air-handler of the existing ventilation system, and a fastener adjustably mated to the second end cap and oriented transversely to the rod. Advantageously, the fastener is configured to permit selected reciprocal displacement of the rod and the hook-shaped implement through the second end cap and relative to a position of the pipe.

In a non-limiting exemplary embodiment, the rod is telescopically housed within the pipe and linearly displaced along a longitudinal axis of the pipe.

In a non-limiting exemplary embodiment, the hook-shaped implement is spaced from and adjustably positioned relative to a stationary position of the pipe, the bracket, and the flashlight.

In a non-limiting exemplary embodiment, the bracket is at least partially circumscribed about an outer perimeter of the pipe.

In a non-limiting exemplary embodiment, the fastener is threadably and rotatably inserted through the second end cap such that the fastener is directly engaged with the rod for restricting the linear displacement of the rod relative to the pipe.

In a non-limiting exemplary embodiment, the magnet has a disc shape provided with a planar top surface registered parallel to the longitudinal axis of the pipe.

In a non-limiting exemplary embodiment, the flashlight is configured to emit an illuminating light array in a direction parallel to the longitudinal axis of the pipe for assisting the user to view an interior of the existing ventilation system while the magnet is statically engaged to an interior wall of the air-handler of the existing ventilation system.

In a non-limiting exemplary embodiment, the bracket has a pair of oppositely faced and coextensively U-shaped sections conjoined together. Advantageously, the pipe is intercalated between a first one of the U-shaped sections and the flashlight is intercalated between a second one of the U-shaped sections.

The present disclosure further includes a method of utilizing a filter hook. Such a method includes the initial step of: providing a pipe having a handle portion suitably configured to enable a user to manipulate the pipe and grab an existing filter from an existing industrial air-handler and existing heating and cooling air coils of an existing ventilation system. Notably, the pipe is hollow and has an elongated rectilinear tube shape provided with a proximal end and an axially opposed distal end. Such a pipe further includes a first end cap attached to a proximal end of the pipe, and a second end cap attached to a distal end of the pipe. The method further includes the steps of: providing and slidably disposing a rod through the pipe; providing and statically coupling a hook-shaped implement to the rod; disposing the hook-shaped implement exterior of the pipe; providing and attaching a bracket to an exterior of the pipe; spacing the bracket from the rod; providing and attaching a flashlight to the bracket; and disposing the flashlight opposite to the handle portion and adjacent to the second end cap. The method further includes the steps of: providing and statically coupling a magnet to the second end cap; providing and adjustably mating a fastener to the second end cap; orienting the fastener transversely to the rod; the fastener permitting selected reciprocal displacement of the rod and the hook-shaped implement through the second end cap and relative to a position of the pipe; manipulating the pipe, via the handle portion, and grabbing an existing filter from an existing industrial air-handler and existing heating and cooling air coils of an existing ventilation system; and freeing up both hands of the user by attaching the magnet to an interior of an existing air-handler access door such that the magnet supporting the pipe and the rod at a stationary position at the existing industrial air-handler of the existing ventilation system.

The method of claim 10, further including the step of: the user illuminating an interior of the existing ventilation system by directing the flashlight towards darkened areas inside the existing industrial air-handler and the existing heating and cooling air coils of the existing ventilation system.

In a non-limiting exemplary embodiment, the method further includes the step of: a user looking down the existing industrial air-handler and the existing heating and cooling air coils of the existing ventilation system thereby inspecting the heating and cooling air coils during a cleaning procedure.

In a non-limiting exemplary embodiment, the method further includes the step of: the user checking existing fan belts for any cracks within the existing industrial air-handler of the existing ventilation system.

In a non-limiting exemplary embodiment, the method further includes the step of: the user greasing each of an existing motor bearing, an existing fan blade bearing, and an existing fan blade assembly without carrying a separate flashlight from the flashlight of the filter hook.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 5:
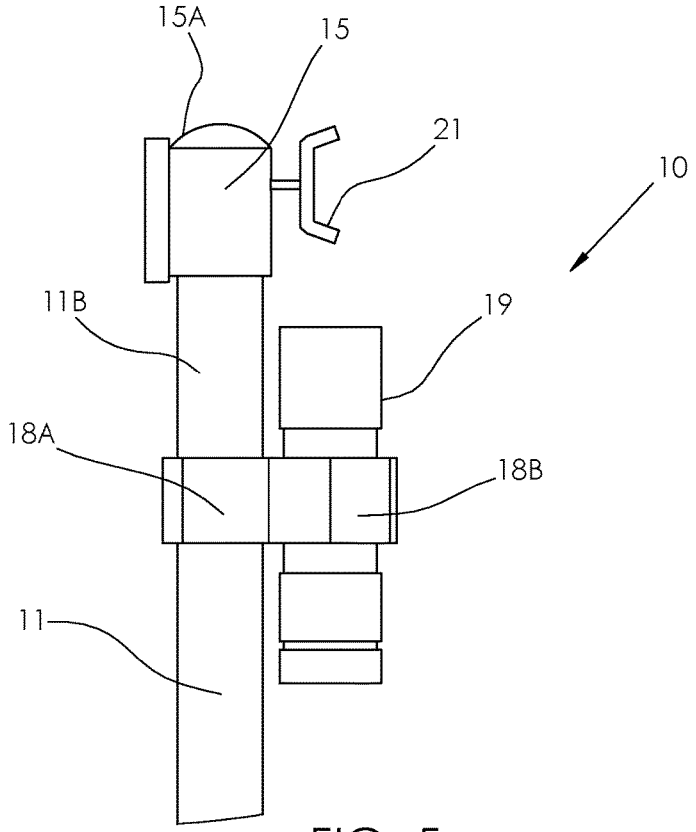
FIG. 5 is an enlarged partially side elevational view of the distal end of the filter hook system, in accordance with a non-limiting exemplary embodiment of the present disclosure.
Figure 6:
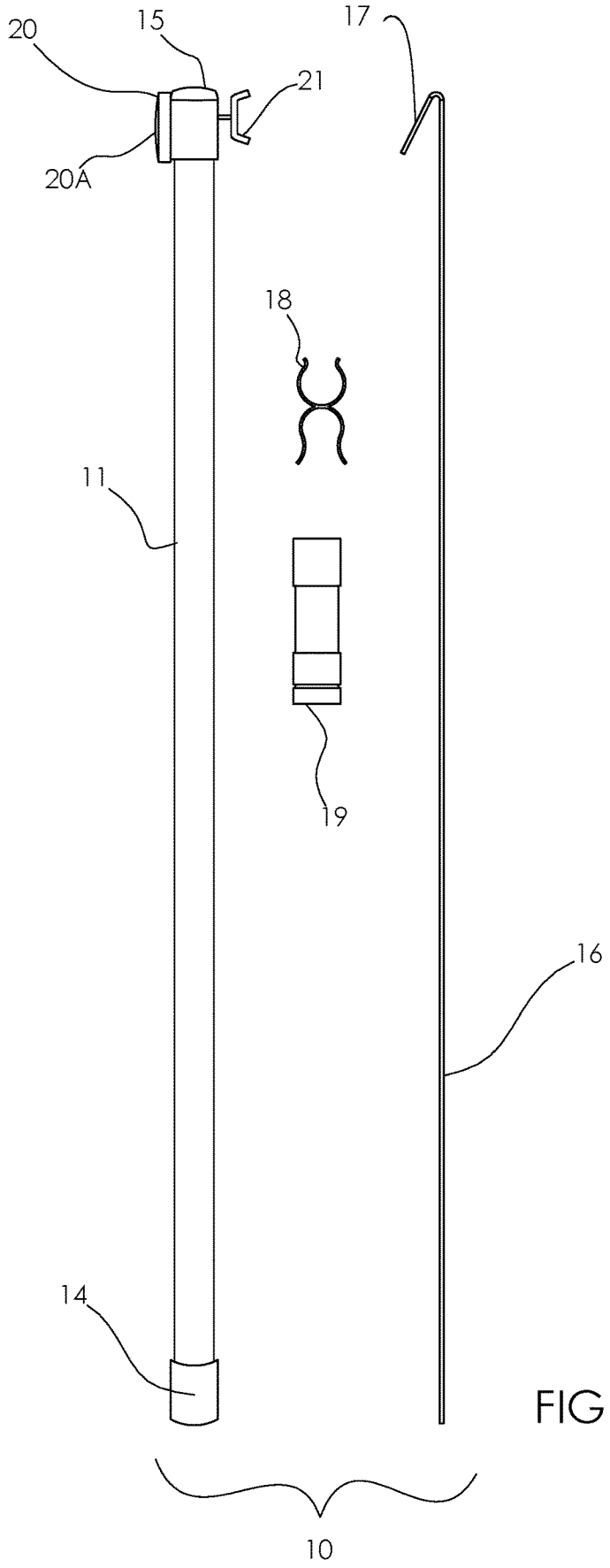
Figure 7:
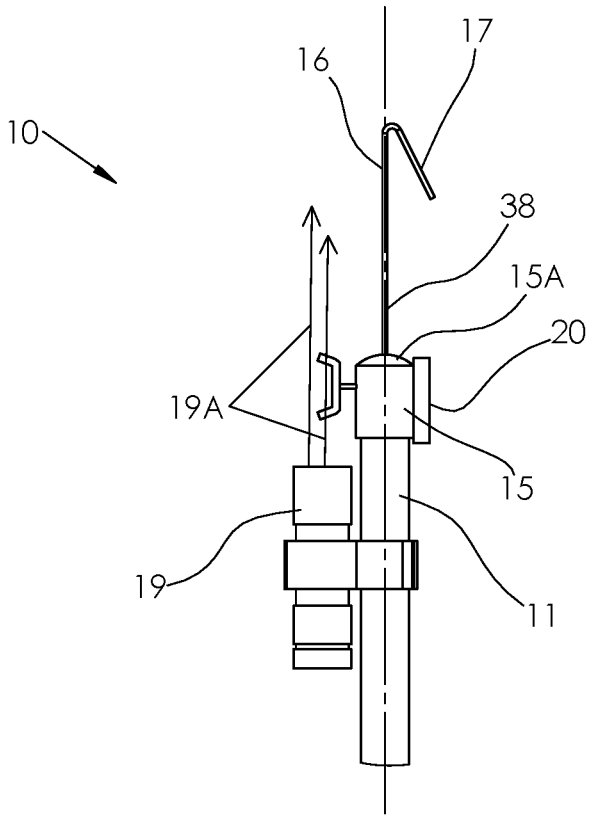

FIG. 6 is an exploded view of the filter hook system, in accordance with a non-limiting exemplary embodiment of the present disclosure; and FIG. 7 is an enlarged partial side elevational view of the distal end of the filter hook system shown in FIG. 5 wherein the rod is partially extracted out from the pipe via an aperture in the second end cap, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-7 and is/are intended to provide a multi-purpose filter hook 10 configured to remove a filter from an existing industrial air-handler of an existing ventilation system, as well as facilitate a hands-free illuminated inspection of at least existing heating and cooling air coils of the existing ventilation system. The filter hook 10 includes a handle portion 12, which is made from light weight polyvinyl chloride (PVC). A stainless bracket 18 holds a flashlight 19 adjacent to the handle portion 12. A magnet 20 holds up to sixteen pounds and is configured to support the filter hook 10 at a stored position (e.g., against an inner wall of the existing air-handler of the existing ventilation system. The rod 16 may contain aluminum and assists a user to grab filters from industrial air-handlers. At least one wingnut screw (fastener 21) holds down the PVC pipe 11 relative to the aluminum rod 16 extending outwardly therefrom. Advantageously, flashlight 19 provides light on darkened areas.

In a non-limiting exemplary embodiment, the present disclosure provides a filter hook 10 useful for removing a filter from a ventilation system. The tool has a tubular handle portion 12 and a rod 16 which may slide within the pipe 11. The rod 16 terminates in a hook 17 for engaging a filter. The tool may also include a flashlight bracket 18 clamped to the pipe 11. The tubular handle portion 12 may be constructed of ½" PVC pipe and may be 2' in length. The rod 16 may be constructed of aluminum and have a ⅜" hook 17 bent at 45 degrees. A wingnut fastener 21 may be attached to the second end cap 15 for stabilizing the hook 17 at a desired length.

In a non-limiting exemplary embodiment, the filter hook 10 finds use within the difficult world of changing filters in industrial settings. This present disclosure allows air-handlers the equipment personnel to remove necessary filters at military bases, hospitals, schools, and all buildings such as skyscrapers that uses cooling tower industrial air-handlers.

In a non-limiting exemplary embodiment, the filter hook 10 may include a variety of components: pipe 11, handle portion 12, magnet 20, flashlight 19, endcaps 14, 15, a wingnut screw (fastener 21), filter hook 10, and the (preferably) stainless bracket 18. The handle portion 12 is preferably made from PVC material for strength and durability. Magnet 20 can hold sixteen pounds of weight is used to attach the filter hook 10 to an internal wall of the existing ventilation system. Flashlight 19 is used to view areas in unlit and space limited dark areas within the existing ventilation system. Advantageously, wingnut screw (fastener 21) holds rod 16 and implement 17 at a desired extended position relative to pipe 11. A stainless bracket 18 holds the flashlight 19 adjacent to the egress location of rod 16 at second end cap 15.

Use of the filter hook 10 relieves the difficulty in removing filters. As designed, the filter hook 10 helps remove the filter from an industrial air-handler and outside air coil, which are difficult to reach due to space restrictions and limited access points.

The filter hook 10 assists the user because it has a mini-flashlight 19 attached to it that helps the user look down the air-handler to inspect the cooling and heating coils to see if they need cleaning. The unit also has a magnet 20 glued (or otherwise attached) to the handle so that the user can attach it to the inner wall (body) of the air-handler to free up his/her hands. With the mini flashlight 19 attached to pipe 11, the user can check the fan belts for any cracks, and this feature allows the capability to grease the motor bearing, fan blade bearings, fan blade assembly without carrying a separate flashlight 19. In this way the present disclosure is multipurpose tool.

When the user finishes using the filter hook 10 for maintenance on the air-handler, the filter hook 10 with the magnet 20 can be attached on any metal wall such as the air-handler access door so the user will always have it ready to be used when he/she needs it.

Figure 1:
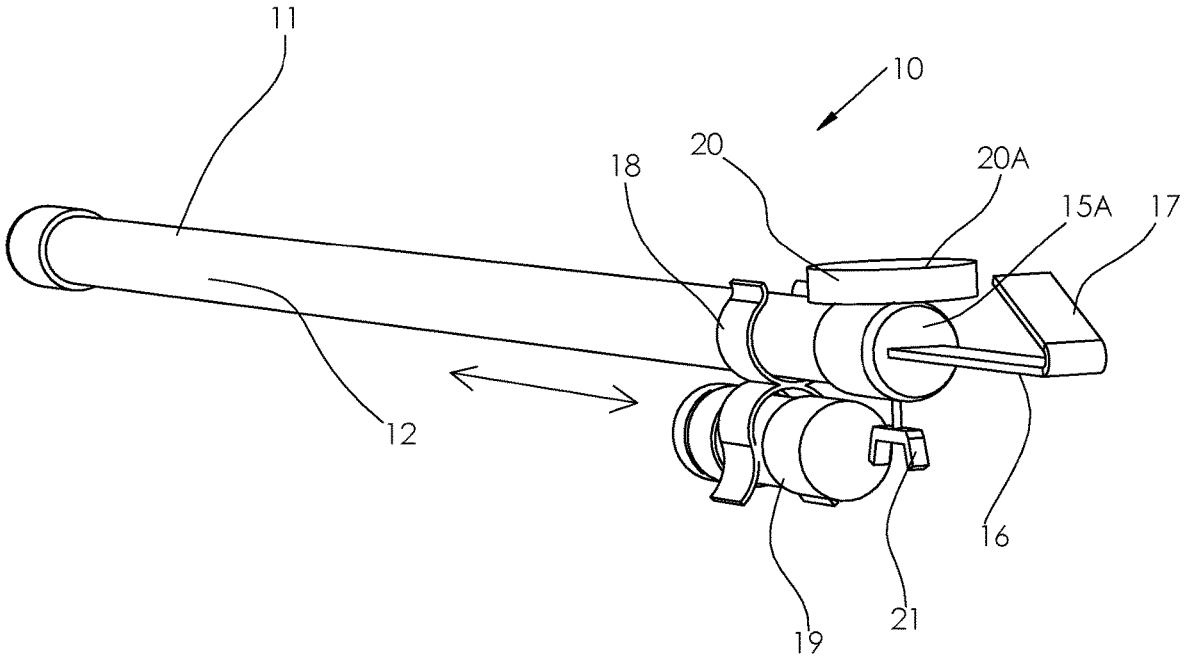
FIG. 1 is a perspective view of a filter hook system, in accordance with a non-limiting exemplary embodiment of the present disclosure.
Figure 2:
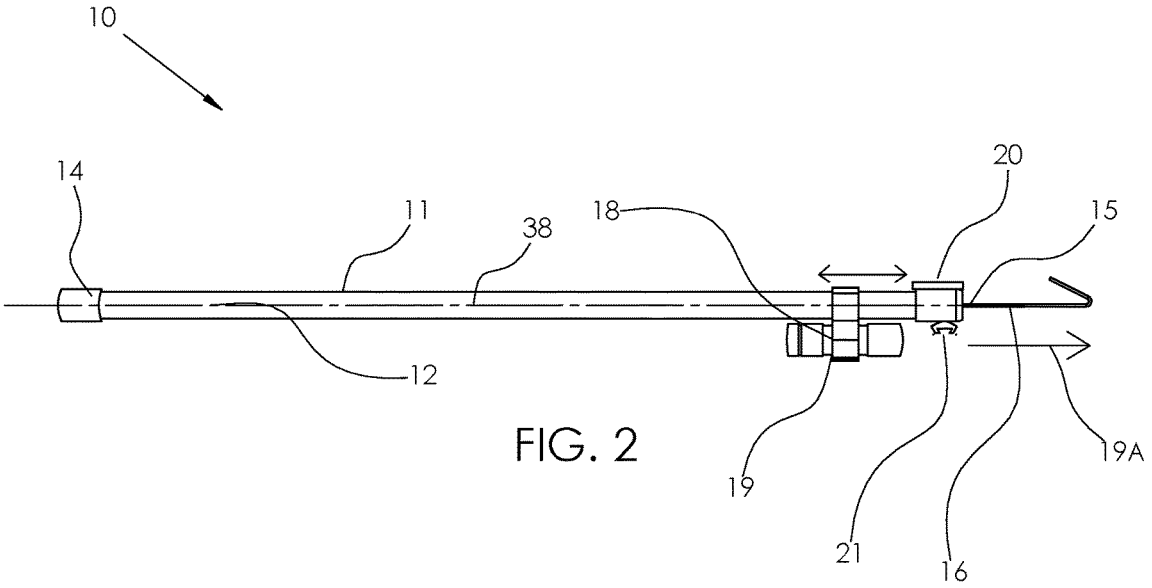
FIG. 2 is side elevational view of the filter hook system shown in FIG. 1, in accordance with a non-limiting exemplary embodiment of the present disclosure.
Figure 3:
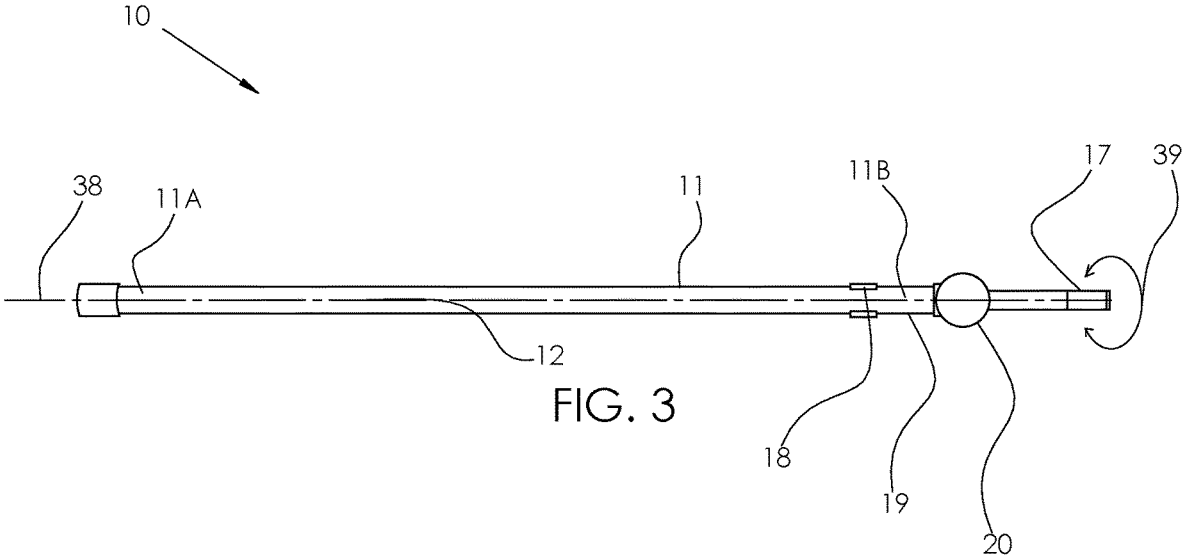
FIG. 3 is top plan view of the filter hook system shown in FIG. 1, in accordance with a non-limiting exemplary embodiment of the present disclosure.
Figure 4:
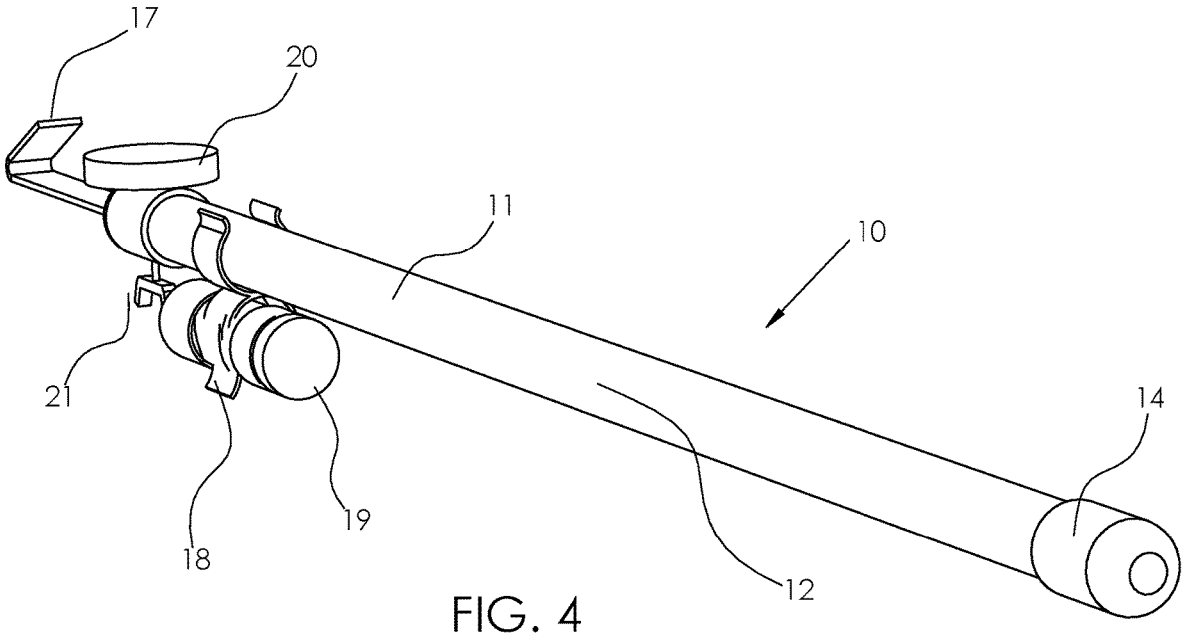
FIG. 4 is another perspective view of the filter hook system shown in FIG. 1, in accordance with a non-limiting exemplary embodiment of the present disclosure.

FIG. 1 shows the front part of the filter hook 10 in a three-point perspective; FIG. 2 shows the side of the filter hook 10; FIG. 3 shows the top part of the filter hook 10; and FIG. 4 shows the back part of the filter hook 10 in a three-point perspective. The handle portion 12 is part of the pipe 11, wherein both components are preferably made from lightweight PVC. The stainless bracket 18 holds the flashlight 19 (illuminating means) to a distal end 11*b* of pipe 11. The magnet 20 holds up to sixteen pounds in preferred embodiments. The rod 16 is preferably aluminum so that it can be resiliently bent to a desired shape after being extended out from aperture 15*a* at end end cap 15. Rod 16 terminates at a hook-shaped implement 17 suitably configured to grab filters from industrial air-handlers when manipulated as such. Due to its hook-shape, implement 17 is prohibited from being retracted into pipe 11 via aperture 15*a*. The wingnut screw (fastener 21) holds down flexible rod 16 relative to second end cap 15 and pipe 11, after rod 16 is egressed from pipe 11. The flashlight 19 provides light for use in darkened areas. The exact specifications, materials used, and method of use of the filter hook 10 system may vary upon manufacturing.

Referring again to FIGS. 1-7 in general, the filter hook 10 includes a pipe 11 having a handle portion 12 monolithically formed therewith and suitably configured to enable a user to manipulate the pipe 11 and grab an existing filter from an existing industrial air-handler and existing heating and cooling air coils of an existing ventilation system. Such a pipe 11 is hollow and has an elongated rectilinear tube shape (with an axial bore therein) provided with a proximal end 11*a* and an axially opposed distal end 11*b*. The pipe 11 further includes a first end cap 14 attached to a proximal end 11*a* of the pipe 11, and a second end cap 15 attached to a distal end 11*b* of the pipe 11. The filter hook 10 further includes a rod 16 slidably disposed through the pipe 11 (and passed through aperture 15*a* at second end cap 15), a hook-shaped implement 17 statically coupled to the rod 16 and disposed exterior of the pipe 11, a bracket 18 attached to an exterior of the pipe 11 and spaced from the rod 16, a flashlight 19 attached to the bracket 18 and disposed opposite to the handle portion 12 and adjacent to the second end cap 15, a magnet 20 statically coupled to the second end cap 15 and configured to support the pipe 11 and the rod 16 at a stationary position at the existing industrial air-handler of the existing ventilation system, and a fastener 21 adjustably mated to the second end cap 15 and oriented transversely to the rod 16. Advantageously, the fastener 21 is configured to pass through end cap 15 and permit selected reciprocal displacement of the rod 16 and the hook-shaped implement 17 through the second end cap 15 and relative to a position of the pipe 11. Such a structural configuration provides the new, useful, and unexpected result of enabling a user to grab an existing filter from an existing industrial air-handler and existing heating and cooling air coils of an existing ventilation system, while also illuminating an interior of the existing ventilation system in a hands-free manner so the user can examine the components inside the existing ventilation system without having to hold the filter hook 10.

In a non-limiting exemplary embodiment, each of the rod 16 and bracket 18 are independently and selectively rotatable in clockwise and counterclockwise directions 39 about the longitudinal axis 38. Such a structural configuration provides the new, useful, and unexpected result of positioning the flashlight 19 and hook-shaped implement 17 at desired positions relative to the distal end 11*b* of pipe 11.

In a non-limiting exemplary embodiment, the rod 16 is telescopically housed within the pipe 11 and linearly displaced along a longitudinal axis 38 of the pipe 11.

In a non-limiting exemplary embodiment, the hook-shaped implement 17 is spaced from and adjustably positioned relative to a stationary position of the pipe 11, the bracket 18, and the flashlight 19. Advantageously, the hook-shaped implement 17 is freely manipulated (rotational and linear directions) to access the filter while the pipe 11 remaining stationary in a space-confined target zone inside the existing ventilation system.

In a non-limiting exemplary embodiment, the bracket 18 is at least partially circumscribed about an outer perimeter of the pipe 11, and can be slidably adjusted along (and detached from) the longitudinal axis 38 as needed.

In a non-limiting exemplary embodiment, the fastener 21 is threadably and rotatably inserted through the second end cap 15 such that the fastener 21 is directly engaged with the rod 16 for restricting the linear displacement of the rod 16 relative to the pipe 11.

In a non-limiting exemplary embodiment, the magnet 20 has a disc shape provided with a planar top surface 20*a* registered parallel to the longitudinal axis 38 of the pipe 11.

In a non-limiting exemplary embodiment, the flashlight 19 is configured to emit an illuminating light rays 19*a* in a direction parallel to the longitudinal axis 38 of the pipe 11 for assisting the user to view an interior of the existing ventilation system while the magnet 20 is statically engaged to an interior wall of the air-handler of the existing ventilation system.

In a non-limiting exemplary embodiment, the bracket 18 has a pair of oppositely faced and coextensively U-shaped sections 18*a*, 18*b* conjoined together. Advantageously, the pipe 11 is intercalated between a first one 18*a* of the U-shaped sections and the flashlight 19 is intercalated between a second one 18*b* of the U-shaped sections.

The present disclosure further includes a method of utilizing a filter hook 10. Such a method includes the initial step of: providing a pipe 11 having a handle portion 12 suitably configured to enable a user to manipulate the pipe 11 and grab an existing filter from an existing industrial air-handler and existing heating and cooling air coils of an existing ventilation system. Advantageously, the pipe 11 is hollow and has an elongated rectilinear tube shape provided with a proximal end 11*a* and an axially opposed distal end 11*b*. Such a pipe 11 further includes a first end cap 14 attached to a proximal end 11*a* of the pipe 11, and a second end cap 15 attached to a distal end 11*b* of the pipe 11. The method further includes the steps of: providing and slidably disposing a rod 16 through the pipe 11; providing and statically coupling a hook-shaped implement 17 to the rod 16; disposing the hook-shaped implement 17 exterior of the pipe 11; providing and attaching a bracket 18 to an exterior of the pipe 11; spacing the bracket 18 from the rod 16; providing and attaching a flashlight 19 to the bracket 18; and disposing the flashlight 19 opposite to the handle portion 12 and adjacent to the second end cap 15. The method further includes the steps of: providing and statically coupling a magnet 20 to the second end cap 15; providing and adjustably mating a fastener 21 to the second end cap 15; orienting the fastener 21 transversely to the rod 16; the fastener 21 permitting selected reciprocal displacement of the rod 16 and the hook-shaped implement 17 through the second end cap 15 and relative to a position of the pipe 11; manipulating the pipe 11, via the handle portion 12, and grabbing an existing filter from an existing industrial air-handler and existing heating and cooling air coils of an existing ventilation system; and freeing up both hands of the user by attaching the magnet 20 to an interior of an existing air-handler access door such that the magnet 20 supporting the pipe 11 and the rod 16 at a stationary position at the existing industrial air-handler of the existing ventilation system.

In a non-limiting exemplary embodiment, the method further includes the step of: the user illuminating an interior of the existing ventilation system by directing the flashlight 19 towards darkened areas inside the existing industrial air-handler and the existing heating and cooling air coils of the existing ventilation system.

In a non-limiting exemplary embodiment, the method further includes the step of: a user looking down the existing industrial air-handler and the existing heating and cooling air coils of the existing ventilation system thereby inspecting the heating and cooling air coils during a cleaning procedure.

In a non-limiting exemplary embodiment, the method further includes the step of: the user checking existing fan belts for any cracks within the existing industrial air-handler of the existing ventilation system.

In a non-limiting exemplary embodiment, the method further includes the step of: the user greasing each of an existing motor bearing, an existing fan blade bearing, and an existing fan blade assembly without carrying a separate flashlight from the flashlight 19 of the filter hook 10.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A filter hook comprising:

a pipe having a handle portion suitably configured to enable a user to manipulate said pipe and grab an existing filter from an existing industrial air-handler and existing heating and cooling air coils of an existing ventilation system, wherein said pipe is hollow and has an elongated rectilinear tube shape provided with a proximal end and an axially opposed distal end, wherein said pipe further includes a first end cap attached to a proximal end of said pipe, and a second end cap attached to a distal end of said pipe;

a rod disposed through said pipe;

a hook-shaped implement coupled to said rod and disposed exterior of said pipe;

a bracket attached to an exterior of said pipe and spaced from said rod;

a flashlight attached to said bracket and disposed opposite to said handle portion and adjacent to said second end cap;

a magnet coupled to said second end cap and configured to support said pipe and said rod at a stationary position at the existing industrial air-handler of the existing ventilation system; and a fastener mated to said second end cap and oriented transversely to said rod;

wherein said fastener is configured to permit selected reciprocal displacement of said rod and said hook-shaped implement through said second end cap and relative to a position of said pipe.

2. A filter hook comprising:

a pipe having a handle portion suitably configured to enable a user to manipulate said pipe and grab an existing filter from an existing industrial air-handler and existing heating and cooling air coils of an existing ventilation system, wherein said pipe is hollow and has an elongated rectilinear tube shape provided with a proximal end and an axially opposed distal end, wherein said pipe further includes a first end cap attached to a proximal end of said pipe, and a second end cap attached to a distal end of said pipe;

a rod slidably disposed through said pipe;

a hook-shaped implement statically coupled to said rod and disposed exterior of said pipe;

a bracket attached to an exterior of said pipe and spaced from said rod;

a flashlight attached to said bracket and disposed opposite to said handle portion and adjacent to said second end cap;

a magnet statically coupled to said second end cap and configured to support said pipe and said rod at a stationary position at the existing industrial air-handler of the existing ventilation system; and a fastener adjustably mated to said second end cap and oriented transversely to said rod;

wherein said fastener is configured to permit selected reciprocal displacement of said rod and said hook-shaped implement through said second end cap and relative to a position of said pipe.

3. The filter hook of claim 2, wherein said rod is flexible and resilient, wherein said rod is telescopically housed within said pipe and linearly displaced along a longitudinal axis of said pipe.

4. The filter hook of claim 3, wherein said hook-shaped implement is spaced from and adjustably positioned relative to a stationary position of said pipe, said bracket, and said flashlight.

5. The filter hook of claim 4, wherein said bracket is at least partially circumscribed about an outer perimeter of said pipe.

6. The filter hook of claim 5, wherein said fastener is threadably and rotatably inserted through said second end cap such that said fastener is directly engaged with said rod for restricting said linear displacement of said rod relative to said pipe.

7. The filter hook of claim 6, wherein said magnet has a disc shape provided with a planar top surface registered parallel to the longitudinal axis of said pipe.

8. The filter hook of claim 7, wherein said flashlight is configured to emit an illuminating light array in a direction parallel to the longitudinal axis of said pipe for assisting the user to view an interior of the existing ventilation system while said magnet is statically engaged to an interior wall of the air-handler of the existing ventilation system.

9. The filter hook of claim 8, wherein said bracket has a pair of oppositely faced and coextensively U-shaped sections conjoined together, wherein said pipe is intercalated between a first one of said U-shaped sections and said flashlight is intercalated between a second one of said U-shaped sections.

10. A method of utilizing a filter hook, said method comprising the steps of:

providing a pipe having a handle portion suitably configured to enable a user to manipulate said pipe and grab an existing filter from an existing industrial air-handler and existing heating and cooling air coils of an existing ventilation system, wherein said pipe is hollow and has an elongated rectilinear tube shape provided with a proximal end and an axially opposed distal end, wherein said pipe further includes a first end cap attached to a proximal end of said pipe, and a second end cap attached to a distal end of said pipe;

providing and slidably disposing a rod through said pipe;

providing and statically coupling a hook-shaped implement to said rod;

disposing said hook-shaped implement exterior of said pipe;

providing and attaching a bracket to an exterior of said pipe;

spacing said bracket from said rod;

providing and attaching a flashlight to said bracket;

disposing said flashlight opposite to said handle portion and adjacent to said second end cap;

providing and statically coupling a magnet to said second end cap;

providing and adjustably mating a fastener to said second end cap;

orienting said fastener transversely to said rod;

said fastener permitting selected reciprocal displacement of said rod and said hook-shaped implement through said second end cap and relative to a position of said pipe;

manipulating said pipe, via said handle portion, and grabbing an existing filter from an existing industrial air-handler and existing heating and cooling air coils of an existing ventilation system;

freeing up both hands of the user by attaching said magnet to an interior of an existing air-handler access door such that said magnet supporting said pipe and said rod at a stationary position at the existing industrial air-handler of the existing ventilation system.

11. The method of claim 10, further comprising the step of:

the user illuminating an interior of the existing ventilation system by directing said flashlight towards darkened areas inside the existing industrial air-handler and the existing heating and cooling air coils of the existing ventilation system.

12. The method of claim 11, further comprising the step of:

a user looking down the existing industrial air-handler and the existing heating and cooling air coils of the existing ventilation system thereby inspecting the heating and cooling air coils during a cleaning procedure.

13. The method of claim 12, further comprising the step of:

the user checking existing fan belts for any cracks within the existing industrial air-handler of the existing ventilation system.

14. The method of claim 13, further comprising the step of:

the user greasing each of an existing motor bearing, an existing fan blade bearing, and an existing fan blade assembly without carrying a separate flashlight from said flashlight of said filter hook.

15. The method of claim 14, wherein said rod is flexible and resilient, wherein said rod is telescopically housed within said pipe and linearly displaced along a longitudinal axis of said pipe.

16. The method of claim 15, wherein said hook-shaped implement is spaced from and adjustably positioned relative to a stationary position of said pipe, said bracket, and said flashlight.

17. The method of claim 16, wherein said bracket is at least partially circumscribed about an outer perimeter of said pipe.

18. The method of claim 17, wherein said fastener is threadably and rotatably inserted through said second end cap such that said fastener is directly engaged with said rod for restricting said linear displacement of said rod relative to said pipe.

19. The method of claim 18, wherein said magnet has a disc shape provided with a planar top surface registered parallel to the longitudinal axis of said pipe.

20. The method of claim 19, wherein said flashlight is configured to emit an illuminating light array in a direction parallel to the longitudinal axis of said pipe for assisting the user to view an interior of the existing ventilation system while said magnet is statically engaged to an interior wall of the air-handler of the existing ventilation system;

wherein said bracket has a pair of oppositely faced and coextensively U-shaped sections conjoined together, wherein said pipe is intercalated between a first one of said U-shaped sections and said flashlight is intercalated between a second one of said U-shaped sections.

* * * * *